US006349644B1

(12) United States Patent
Mohrmann et al.

(10) Patent No.: US 6,349,644 B1
(45) Date of Patent: Feb. 26, 2002

(54) ROLLER

(75) Inventors: Hans Dierk Mohrmann, Höchberg; Bernd Kurt Masuch, Kürnach, both of (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 09/581,237

(22) PCT Filed: Dec. 22, 1998

(86) PCT No.: PCT/DE98/03756

§ 371 Date: Aug. 1, 2000

§ 102(e) Date: Aug. 1, 2000

(87) PCT Pub. No.: WO99/33667

PCT Pub. Date: Jul. 8, 1999

(30) Foreign Application Priority Data

Dec. 24, 1997 (DE) ..... 197 57 815

(51) Int. Cl.[7] ..... B41F 31/00

(52) U.S. Cl. ..... 101/351.6; 101/348

(58) Field of Search ..... 101/348, DIG. 32, 101/148, 349.1, 350.1, 350.3, 351.6, 352.06, 352.1, 352.13

(56) References Cited

U.S. PATENT DOCUMENTS

| | | | | |
|---|---|---|---|---|
| 1,542,221 A | | 6/1925 | De Jarnette | |
| 4,467,720 A | | 8/1984 | Gertsch | 101/348 |
| 4,632,029 A | * | 12/1986 | Simeth | 101/216 |
| 4,802,411 A | * | 2/1989 | Witczak | 101/348 |

FOREIGN PATENT DOCUMENTS

| | | |
|---|---|---|
| DE | 1 132 934 | 7/1962 |
| DE | 32 40 603 | 5/1983 |
| EP | 0 141 189 | 9/1984 |

* cited by examiner

*Primary Examiner*—John S. Hilten
*Assistant Examiner*—Kevin D. Williams
(74) *Attorney, Agent, or Firm*—Jones, Tullar & Cooper, PC

(57) ABSTRACT

A roller is formed of at least two adjacent roller barrels. Each of the roller barrels has its own shaft that defines an axis of rotation for its associated roller barrel. The axes of rotation of the several roller barrels can be independently positioned. A support is located between the two roller barrels and supports the shafts of the two adjacent barrels. This central support is able to be adjusted.

8 Claims, 3 Drawing Sheets

ROLLER

FIELD OF THE INVENTION

The present invention relates to a roller with a plurality of barrels or segments located axially adjacent each other. Axes of rotation of the individual barrels can be positioned independently.

DESCRIPTION OF THE PRIOR ART

EP 0 141 189 B1 describes a film roller with several barrels, whose axes of rotation can be adjusted parallel with each other by means of eccentric displacement devices.

DE 11 32 934 B1 discloses an ink duct without a vibrating roller and with a divided transfer roller. The shafts of the transfer roller segments are supported on a support bearing arranged between the barrels.

SUMMARY OF THE INVENTION

The object of the present invention is based on producing a roller.

In accordance with the present invention, this object is attained by providing a roller having a plurality of axially adjacent barrels. A position of an axis of rotation of at least one barrel can be set independently of the position of the axis of rotation of a second barrel. At least one support bearing is arranged between the two barrels. This support bearing is adjustable.

The advantages which can be achieved by means of the present invention reside, in particular, in that, with a roller with a multi-part barrel, it is possible to adjust an axis of rotation of at least on barrel independently of an axis of rotation of a second barrel. It is particularly advantageous in this situation that these two axes of rotation can be displaced parallel in respect to each other by a single adjusting device. It is thus possible to reduce assembly and maintenance times and to simplify the adjustment work.

For example, for compensating for sagging of this roller or of an adjoining roller, a support in respect to an ink duct, i.e. in respect to a lateral frame, is provided between the sections. This support can be adjustable. It is possible, by use of this device, to set a changeable opening angle, which is not 180°, of the axes of rotation of the two barrels.

BRIEF DESCRIPTION OF THE DRAWINGS

The roller in accordance with the present invention is represented in the drawings and will be described in greater detail in what follows. Shown are in.

DESCRIPTION OF THE PREFERRED EMBODIMENT

Figure 1:
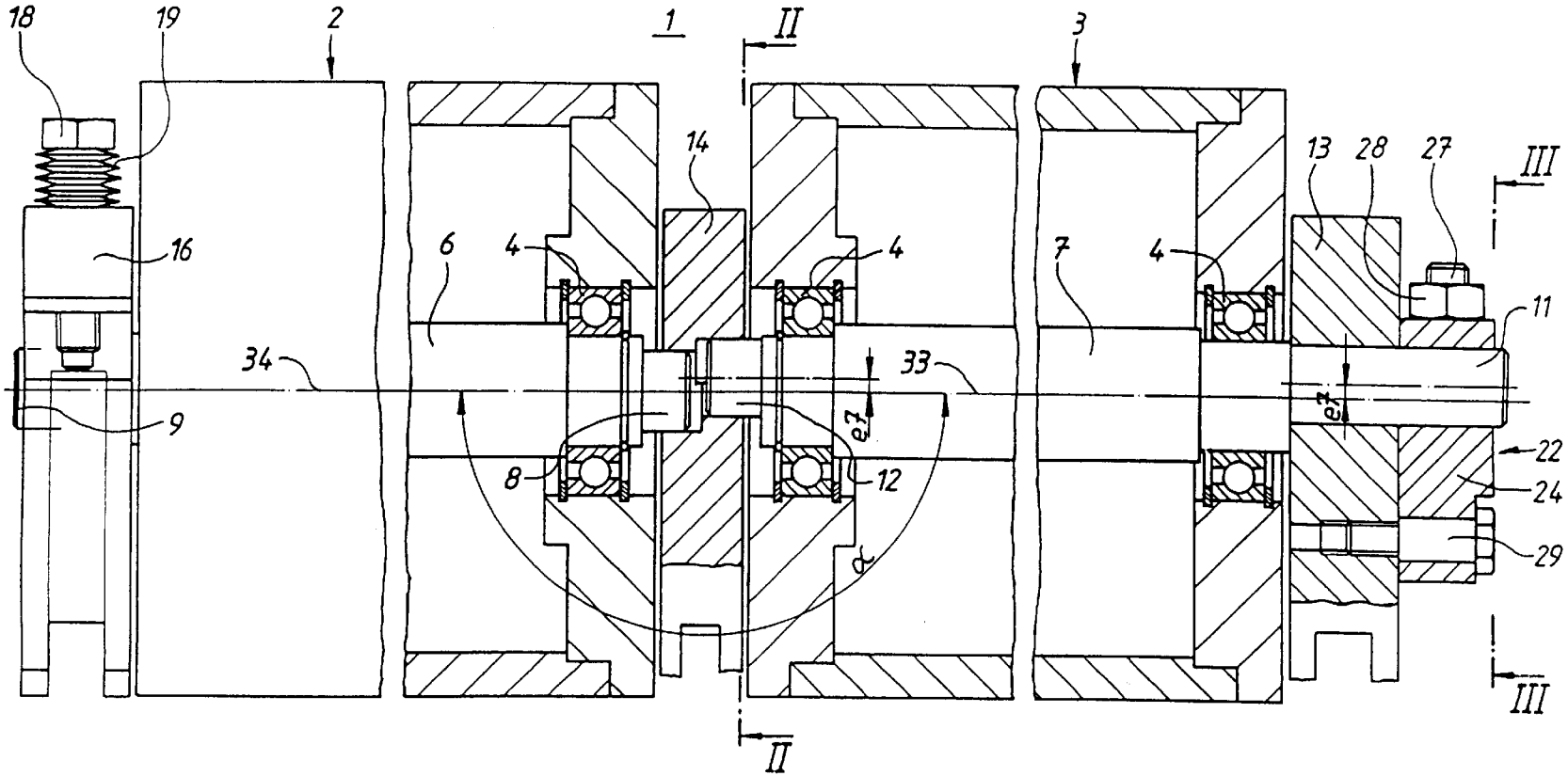
FIG. 1, a schematic cross section, in the longitudinal direction, through a roller in accordance with the present invention, FIG. 2, a schematic cross section through a roller taken a long line II—II in FIG. 1, and in FIG. 3, a schematic and view of a roller in accordance with FIG. 1.

A roller 1 is used for conveying ink and/or dampening agent in a rotary printing press. This roller 1 is preferably used as a film roller in an ink duct and is shown in FIG. 1.

The roller 1 has a plurality of barrels, for example two such, barrels 2, 3, which are arranged next to each other in the axial direction of roller. Each one of these first and second barrels 2, 3 is rotatably seated on its own barrel shaft 6, 7 by rolling bearings 4. The first shaft 6 of the first or left barrel 2 is provided on both its ends with centered journals 8, 9, and the second shaft 7 of the right or second barrel 3 is provided with eccentric journals 11, 12. The centers of the accentric journals 11, 12 of the second shaft 7 are displaced by an amount of eccentricity e7 in respect to a center or center line of a barrel 3.

These four journals 8, 9, 11, 12 are each fastened in pivot levers or arms 13, 14, 16, an are used as support bearings. For this purpose, the left pivot lever 16 has a first, central bore, which is arranged approximately in the center of the pivot lever 16 and whose diameter is matched to a diameter of the journal 9 of the first barrel shaft 6.

A second bore is provided at a first end of the left pivot lever 16. The left pivot lever 16 is pivotably seated on a bearing bolt 17 using this second bore. This bearing bolt 17 is arranged on the ink duct 21, for example, by being fixed on the frame. The pivot lever 16 is provided with an adjustment screw 18 on its second end. This adjustment screw 18 has springs 19 between its head and the pivot lever and is supported at its free end on an ink duct 21, for example, which is fixed on the frame.

Figure 2:
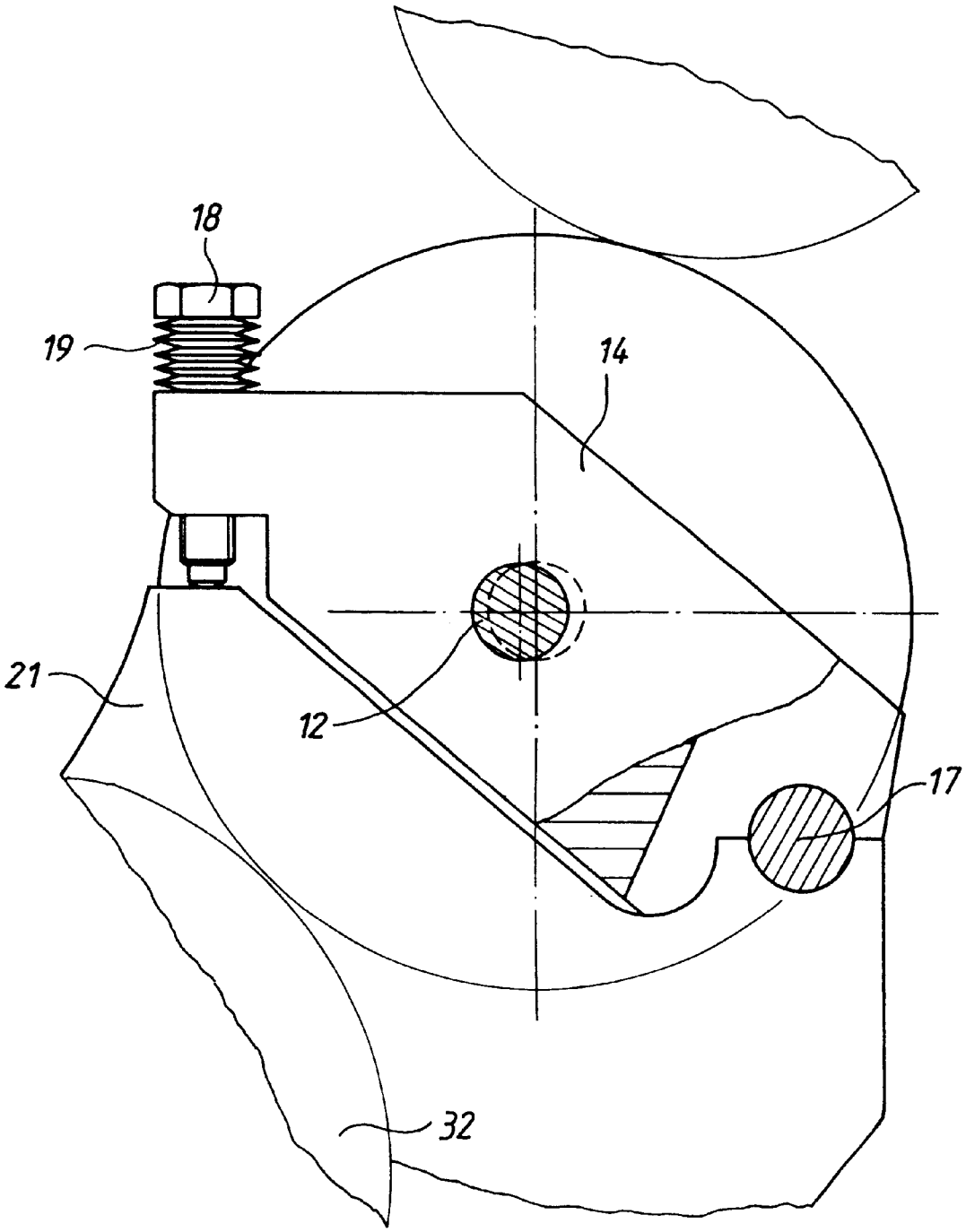

The second and third pivot levers 13, 14 are also embodied to be pivotable and adjustable as may be seen in FIG. 2. The pivotable support of the central pivot lever 16 is depicted in FIG. 2. However, it will be understood that the preceding discussion regarding the left pivot lever 16 is also applicable to the right pivot lever 13 and to the central pivot lever 14. Also, FIG. 2 is to be understood as being generally representative of all three pivot levers 13, 14 and 16.

The third or central pivot lever 14 is arranged centered between the left and right barrels 2, 3 and is provided with two bores as seen most clearly in FIG. 1. These two bores are arranged eccentrically in respect to each other by the amount of eccentricity e7. The right journal 8 of the first or left barrel shaft 6, which left shaft 6 has centered journals 8, 9, is seated in the left bore of the center pivot lever 14. The right bore of the center pivot lever 14 receives the left journal 12 of the second or right barrel shaft 7, which shaft, has eccentric journals.

The right pivot lever 13 is provided with a central bore which is matched in axial alignment to the right bore of the center pivot lever 14, i.e. this right pivot lower central bore is also offset by an amount of an eccentricity e7 in respect to the central bore of the left pivot lever.

The eccentric journals 12, 11 of the second shaft are assigned to the central bore of the center pivot lever 14 and in the central bore of the right pivot lever 13, respectively. The amounts of eccentricity e7 of the journals of the shaft and the eccentricities of the bores are arranged in such a way that the two barrels 2, 3 of the roller 1 are located centered in respect to each other in an initial position.

Figure 3:
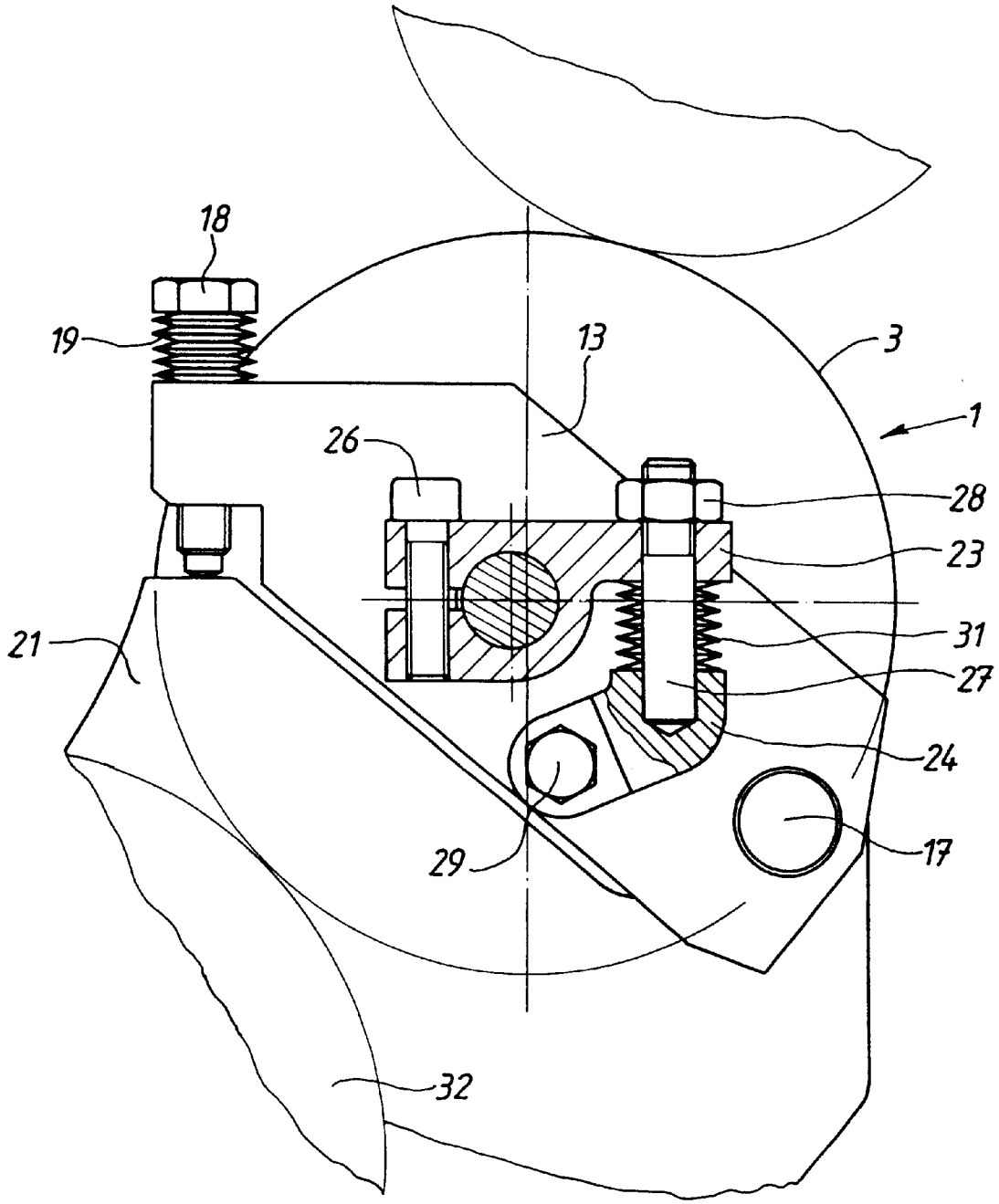

The right journal 11 of the eccentric right barrel shaft 7 protrudes past the right pivot lever 13. Adjusting means, such as an adjustment device 22 are provided for affecting adjustment of the eccentric position of the eccentric shaft 7, and therefore the position of the second barrel 3 of the roller 1. Those adjusting means are arranged on this protruding end of the journal 11. In the present embodiment, as be soon more clearly in FIG. 3, these adjusting means 22 essentially consist of a lever 23 and a counter-support 24. The lever 23 has a journal receiving bore, whose diameter is matched to a diameter of the eccentric journal 11 of the shaft 7. The lever 23 is clamped, fixed against relative rotation, on the free end of the eccentric journal 11 by means of a threaded claiming screw 26, and has a bore on its end.

A threaded bolt 27 projects through this level and bore, and has a first end that is provided with a threaded nut 28. A second end of treaded bolt 27 is fixedly connected, for example is pressed into the counter-support 24. In the present embodiment example, the counter-support 24 is pivotably seated on the right pivot lever 13 by means of a dowel screw 29. Springs 31 are arranged on the threaded bolt 27 between the lever 23 and the counter-support 24.

In an initial position, the three pivot levers 13, 14, 16 are adjusted, in respect to each other, in such a way that the two shafts 6, 7 are aligned with each other, i.e. that the two roller barrels 2, 3 lie coaxially in respect to each other. An even or continuously uniform shaft spacing distance between the two barrels 2, 3 and an adjoining roller 32 can be set in this way. If it is now desired to change the distance of the right barrel 3 from the adjoining roller 32, the shaft 7 is pivoted in respect to the eccentric journals 11, 12 by means of the associated adjustment device 22. In this way, the position of an axis of rotation 33 of the second barrel 3 is changed in relation to an axis of rotation 34 of the first barrel 2. It is, for example, also possible to adjust the center pivot lever 14, or one, or respectively both, outer pivot levers 13, 16, so that the two axes of rotation 33, 34 no longer lie parallel with each other and enclose an opening angle unequal to 180°. If more than two barrels 2, 3 are arranged, it is possible to provide an adjustable support bearing between each respective two barrels, or to assign one adjustable support bearing to a group of barrels. For example, one roller can have four barrels, wherein two barrels are assigned to a common shaft, i.e. a support bearing is only provided in the center.

It is also possible to provide the barrels 2, 3 with journals, which are fixed against relative rotation. In this case the, journals are then rotatably seated in the support bearings. The position of the journals can be adjusted, for example by use of an eccentric adjustment of the pivot levers, or respectively of the support bearings.

While a preferred embodiment of a roller in accordance with the present invention has been set forth fully and completely hereinabove, it will be apparent to one of skill in the art that a number of changes in, for example the drive for the roller, the end use of the roller, any covering on the roller, and the like could be made without departing from the true spirit and scope of the present invention which is accordingly to be limited only by the following claims.

What is claimed is:

1. A roller comprising:

at least a first roller barrel having a first roller barrel axis of rotation and a second roller barrel having a second roller barrel axis of rotation, said at least first and second roller barrels being arranged axially adjacent each other;

means supporting at least one of said at least first and second roller barrels for independent positioning of said at least one of said at least first and second roller barrel axis of rotation with respect to a second one of said at least first and second roller barrel axis of rotation;

at least one roller barrel support arranged between said at least first and second roller barrels, said at least one roller barrel support being adjustable; and a roller barrel shaft with journals for each of said at least first and second roller barrels, said journals of adjoining ones of said at least first and second roller barrels being received in said at least one roller barrel support.

2. The roller of claim 1 wherein each of said at least first and second roller barrels is rotatably supported on a separate one of said roller barrel shafts.

3. The roller of claim 1 wherein at least one of said roller barrel support shaft journals are eccentric.

4. The roller of claim 1 wherein said journals are arranged eccentrically to each other in said roller barrel support.

5. The roller of claim 1 wherein said support is secured on an ink duct.

6. The roller of claim 1 wherein said at least one roller barrel support further includes an eccentric adjustment installation.

7. A roller comprising:

at least a first roller barrel having a first roller barrel shaft supporting said first roller barrel for rotation about a first roller barrel axis of rotation and a second roller barrel having a second roller barrel shaft supporting said second roller barrel for rotation about a second roller barrel axis of rotation, said at least first and second roller barrels being arranged axially adjacent each other;

at least one roller barrel support arranged between said at least first and second roller barrels, said at least one roller barrel support being adjustable; and centered journals on said first roller barrel shaft and eccentric journals on said second roller barrel shaft, said at least one roller barrel support receiving one of said centered journals and one of said eccentric journals for independent positioning of said at least one of said first and second roller barrel axis of rotation with respect to a second one of said at least first and second roller barrel axis of rotation.

8. The roller of claim 7 further including a roller shaft adjustment device, said roller shaft adjustment device receiving one of said eccentric journals.

* * * * *